US005503224A

United States Patent [19]

Field

[11] Patent Number: 5,503,224

[45] Date of Patent: Apr. 2, 1996

[54] CASING DRIVE APPARATUS

[75] Inventor: George R. Field, Edmonton, Canada

[73] Assignee: Big Iron Drilling Ltd., Edmonton, Canada

[21] Appl. No.: 388,429

[22] Filed: Feb. 14, 1995

[30] Foreign Application Priority Data

Jun. 28, 1994 [CA] Canada ..... 2126904

[51] Int. Cl.[6] ..... E21B 23/03

[52] U.S. Cl. ..... 166/117.7; 166/181; 166/24.26; 175/321

[58] Field of Search ..... 166/178, 181, 166/182, 242, 117.7; 175/299, 293, 321, 135, 173, 171

[56] References Cited

U.S. PATENT DOCUMENTS

| | | | |
|---|---|---|---|
| 1,908,217 | 5/1933 | Blumenthal | 175/293 X |
| 3,005,504 | 10/1961 | Mayhew, Jr. | 175/173 X |
| 3,190,378 | 6/1965 | Davey, Sr. et al. | 175/171 X |
| 3,390,730 | 7/1968 | Techy et al. | 175/171 |
| 3,682,260 | 8/1972 | Klemm | 175/92 |
| 3,835,943 | 9/1974 | Bray | 175/173 |
| 3,901,331 | 8/1975 | Djurovic | 175/171 |
| 4,387,776 | 6/1983 | Adcock | 166/178 X |
| 4,415,047 | 11/1983 | Adcock | 175/321 X |

*Primary Examiner*—Frank S. Tsay
*Attorney, Agent, or Firm*—George A. Seaby

[57] ABSTRACT

There is a need for a device for driving plastic casing into a water well, or for removing such casing from the well without damaging the casing. This need is met by a casing drive apparatus which includes a shoe for attachment to the bottom end of a plastic well casing, an annular groove defining a pair of shoulders in the sleeve, a drive sub for insertion into the sleeve, a plurality of dogs pivotally mounted in the drive sub for engaging the shoulders, and helical springs for biasing the dogs outwardly into engagement with the shoulders, whereby, when the sub is slid into the sleeve and the dogs engage the shoulders, vertical force exerted on the sub results in movement of the dogs against the shoulders to effect vertical movement of the sleeve and consequently of the well casing.

7 Claims, 5 Drawing Sheets

CASING DRIVE APPARATUS

BACKGROUND OF THE INVENTION

1. Field of the Invention

This invention relates to a casing drive apparatus, and in particular to a drive apparatus for use with plastic pipe in a water well.

2. Discussion of the Prior Art

In general, in the past well casings for water or oil wells were formed of metal. With the advent of modern plastics, casing for use in water wells are being formed of plastic. When drilling a water well, it is important to effect a good seal between the bottom of the surface casing and the adjacent formation to prevent the ingress of loose surface formation material, water and containments into the well casing. When using plastic casing, the seal is formed by a rubber cup and bentonite, a cement group or other sealants for preventing the entry of surface water into the well casing. In order to form a good seal, a common practice is to pound the casing against the bottom of the well bore. Following drilling, a heavy weight controlled by the drilling rig is transferred to the casing to press the casing against the formation. When plastic pipe is used in a water well, hammering against the casing is likely to cause fracturing of the plastic pipe sections defining the well casing.

If the well being drilled is dry or yields bad water, the casing is removed from the well. When plastic pipe is used to define the casing, it is difficult to remove such pipe from the bore. The pipe sections, which are approximately twenty feet long, commonly stick to the sides of the bore and break under pressure.

3. General Description of the Invention

The object of the present invention is to provide a solution to the above identified problems in the form of a relatively simple casing drive apparatus which can be used to push a plastic drill casing downwardly into a well bore to effect a tight seal or alternatively to remove the casing from the well bore without damaging the casing. At the very least, the casing drive apparatus of the present invention reduces the likelihood of damage to the well casing during downward movement into the well bore or removal of the casing from the bore.

Accordingly, the present invention relates to an apparatus for driving a well casing comprising shoe means for attachment to the bottom end of a well casing; shoulder means in said shoe means; drive sub means for insertion into a drill pipe string slidable in said well casing and in said shoe means; dog means pivotal in said sub means for engaging said shoulder means; and spring means for biasing said dog means outwardly into engagement with said shoulder means, whereby, when said sub means is slid into said shoe means and said dog means engages said shoulder means, vertical force exerted on said sub means will cause said dog means to bear against said shoulder means to effect vertical movement of said shoe means and consequently of the well casing.

BRIEF DESCRIPTION OF THE DRAWINGS

The invention will be described in greater detail with reference to the accompanying drawings which illustrate a preferred embodiment of the invention, and wherein.

DESCRIPTION OF THE PREFERRED EMBODIMENT

Figure 1:
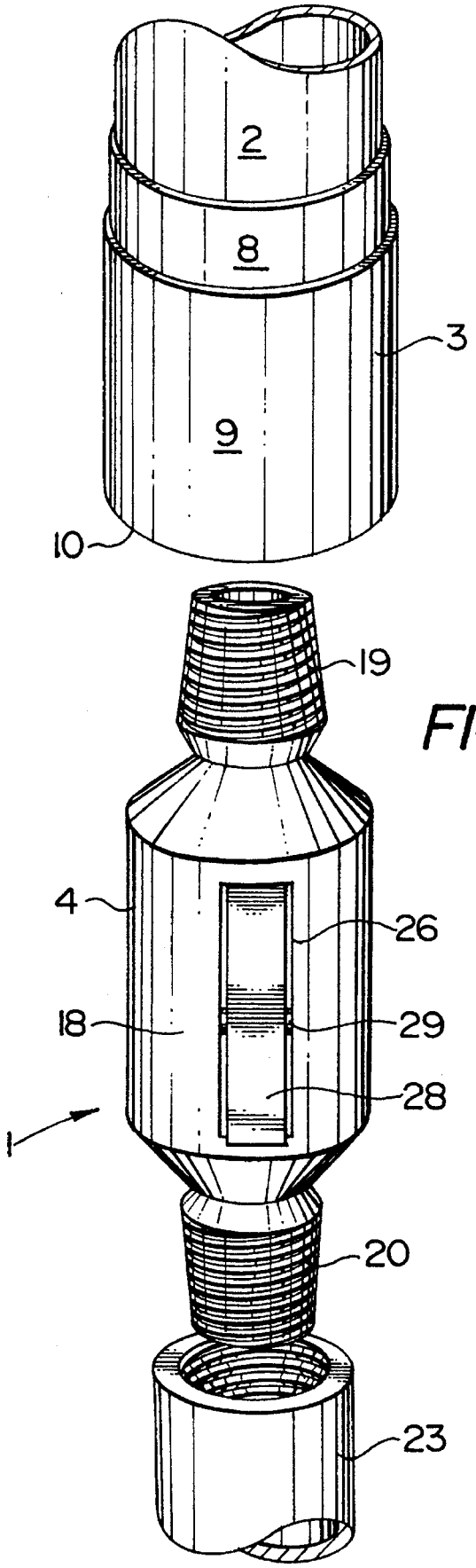
FIG. 1 is an exploded perspective view of an apparatus for driving a well casing in accordance with the present invention.
Figure 2:
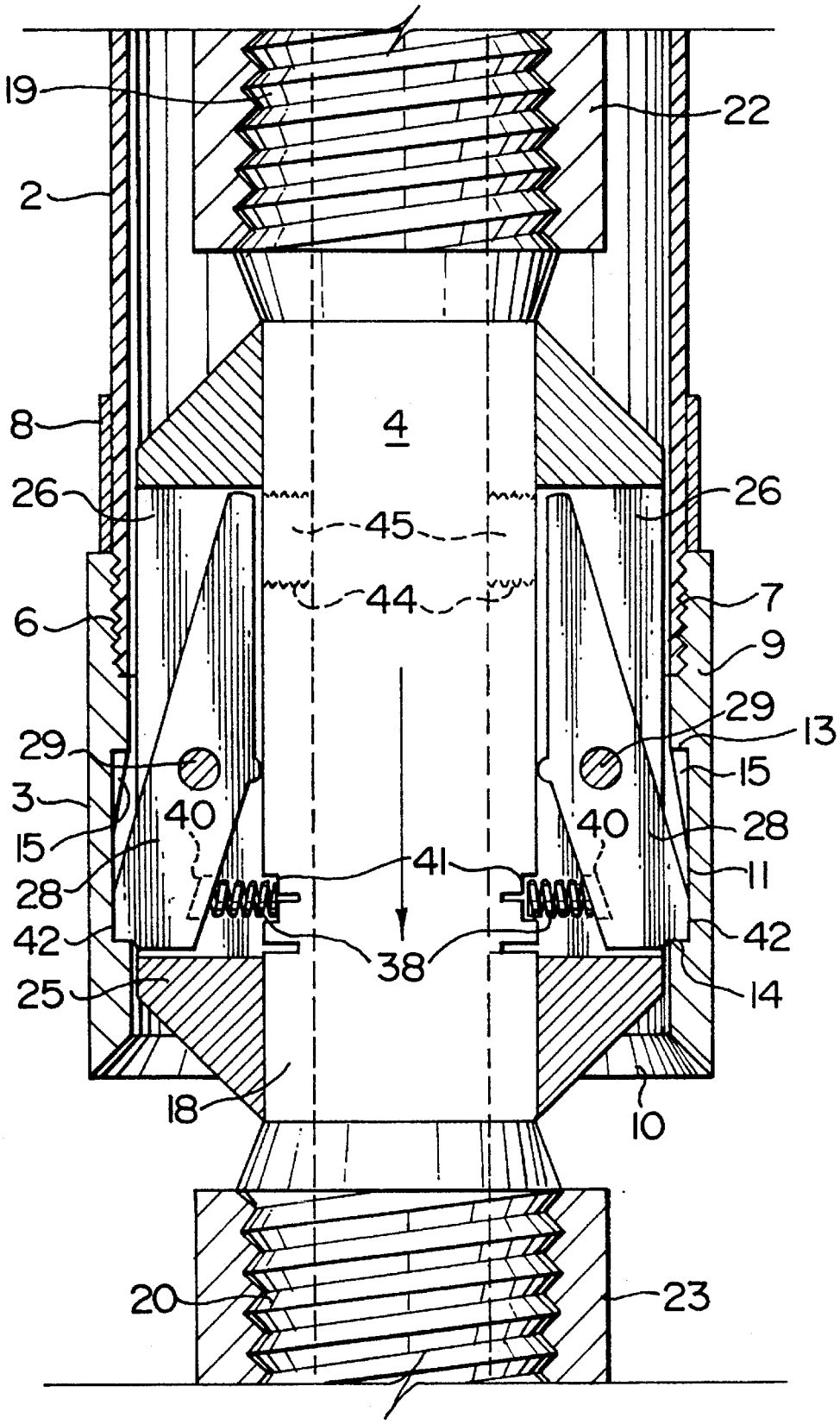
FIG. 2 is a longitudinal sectional view of the apparatus of FIG. 1 during downward movement of a well casing, the section being taken at an angle of 120° (rather than the usual 180°)
Figure 3:
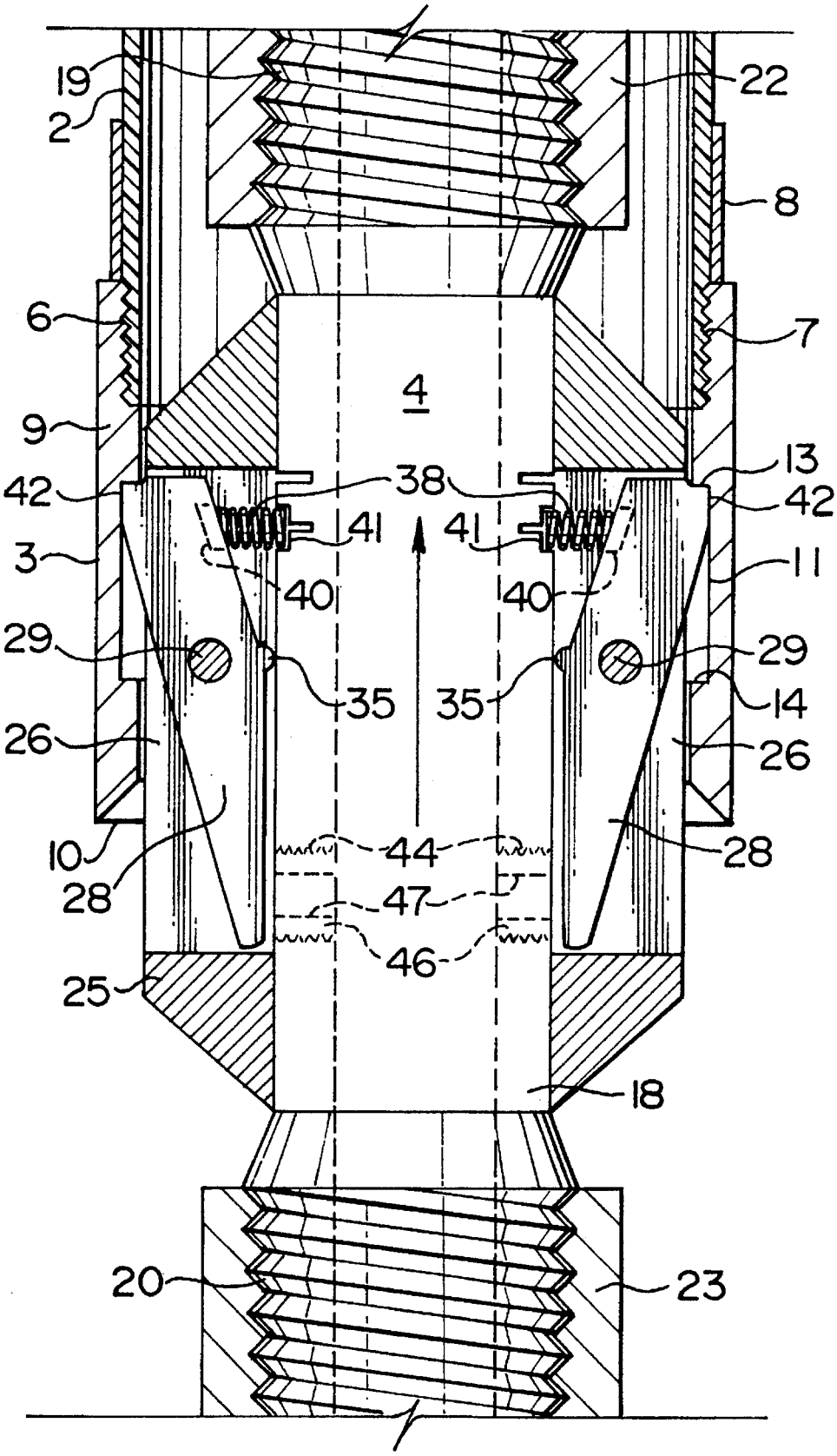
FIG. 3 is a longitudinal sectional view similar to FIG. 2 of the apparatus during upward movement or retraction of a well casing.

With reference to FIGS. 1 to 3, the apparatus for driving the well casing of the present invention which is generally indicated at 1 is designed to push a casing 2 downwardly in a well or to remove the casing from the well. The two basic elements of the drive apparatus include a metal shoe or sleeve 3 for mounting on the bottom end of the casing 2 and a drive sub 4. The bottom end 6 of the casing 2 is externally threaded, and mating internal threads 7 are provided on the top end of the shoe 3. A metal support sleeve 8 is mounted on the casing 2 above the sleeve 3 for ensuring that the plastic casing does not break in the area of the bottom end 6 thereof.

Figure 4:
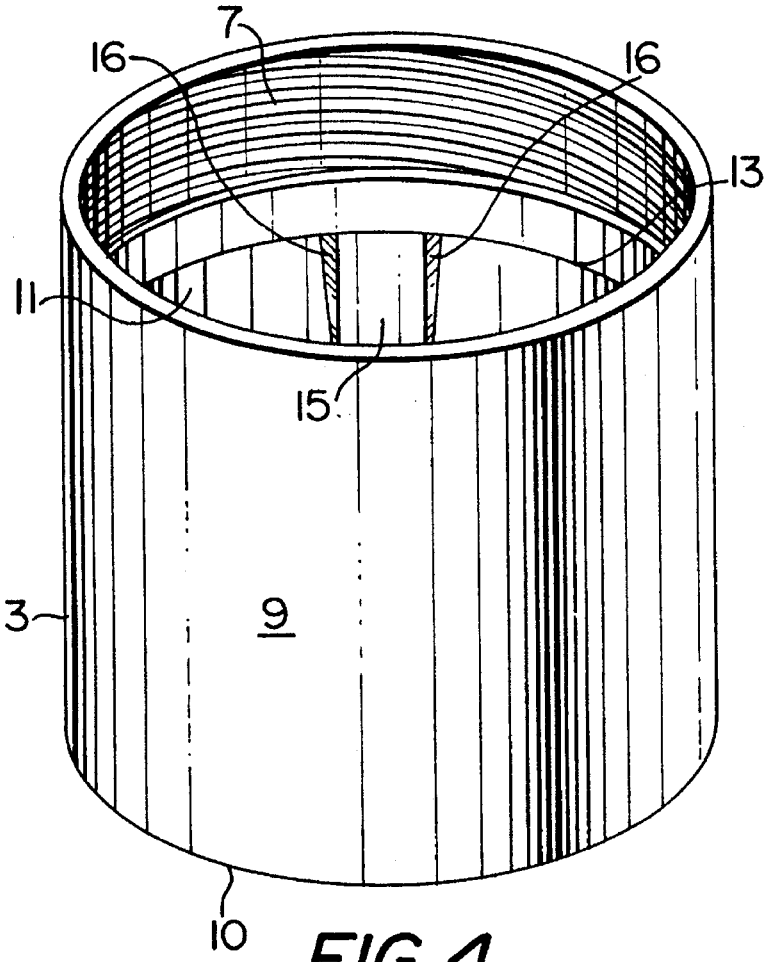
FIG. 4 is a perspective view of a shoe used in the apparatus of FIGS. 1 to 3.
Figure 5:
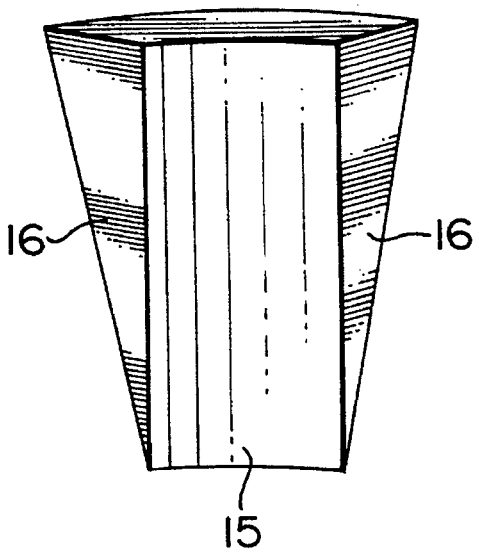
FIG. 5 is a perspective view of a ramp used in the shoe of FIG. 4.

As best shown in FIGS. 2 to 4, the shoe 3 is defined by a cylindrical pipe section 9, with a sharp bottom end 10 facilitating driving of the shoe into the ground to effect a seal between the bottom and side of the shoe and the bottom of a well bore. An annular groove 11 is provided in the shoe 3 defines interior upper and lower shoulders 13 and 14, respectively. Three ramps 15 are provided beneath the upper shoulder 13. The ramps 15, which are at 120° to each other, are merely downwardly tapering bodies with inclined sides 16.

Referring to FIGS. 1 to 3, the drive sub 4 includes a tubular body 18 with tapered upper and lower ends 19 and 20, respectively for mounting in a drill string. The drill string includes a plurality of longitudinally interconnected sections, only two of which are shown. The sub 4 is mounted between two sections 22 and 23 of the string. For such purpose, the tapered ends 19 and 20 of the sub 4 are externally threaded for connection to the internally threaded ends of the sections 22 and 23.

Figure 7:
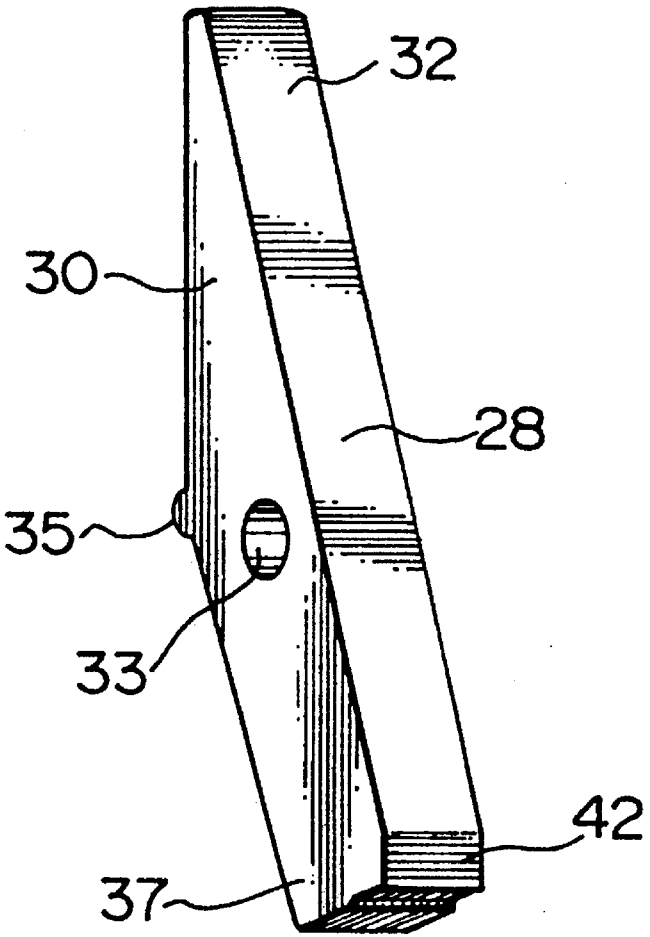
FIGS. 6 and 7 are perspective views of a dog used in the apparatus of FIGS. 1 to 3.
Figure 6:
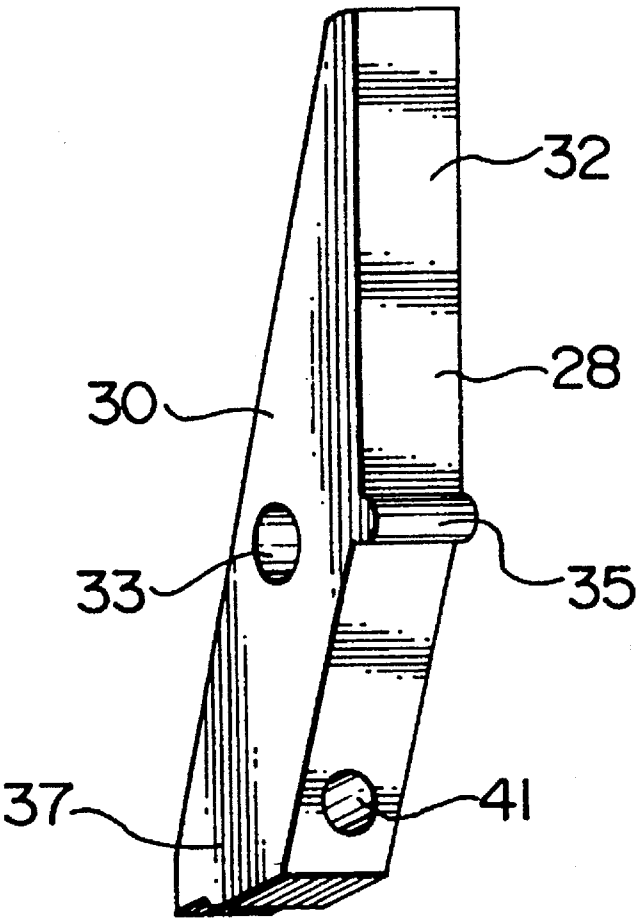

A cylindrical sleeve 25 is provided on the body 18. Of course, the sleeve 25 can be integral with the body 18, i.e. the two parts can be replaced by a single element. The sleeve 25 includes three longitudinally extending slots 26 at 120° to each other. A dog 28 is pivotally mounted on a pin 29 in each slot 26 for rotation around a horizontal axis. As best shown in FIGS. 6 and 7, each dog 28 includes an elongated body 30 with a tapering upper end 32, and a hole 33 therethrough for receiving the pin 29. A small ridge 35 extends outwardly from the inner side of the dog 28 for bearing against the body 18 of the sub 4. The bottom end 37 of each dog 28 is biased outwardly by a helical spring 38, which is retained in recesses 40 and 41 in the dog 28 and the sub body 4, respectively. The outer bottom end 42 of each dog 28 is squared off, i.e. bevelled so that such end 42 defines a square shoulder for fully engaging one of the shoulders 13 or 14 in the sleeve 3. Threaded holes 44 are provided in the body 18 of the sub 4. The holes are closed by solid plugs 45 (FIG. 2) or plugs 46 (FIG. 3) with central passages 47 therethrough. The reason for such different plugs is described hereinafter in greater detail.

During use, the casing drive sub 4 is inserted into a drill string nearer to the bottom than to the top end thereof. For example, the drive sub 4 might be 180 feet beneath the surface and 60 feet above the bottom end of the well. The shoe 3 is mounted on the bottom end of the casing 2 and the sub 4 is moved downwardly into the shoe 3, whereby the springs 38 push the dogs 28 outwardly into the recesses 11. When the ends 42 of the dogs engage the shoulder 14, the weight of the rig is transferred to the drill string for pushing the shoe 3, and consequently the casing 2 downwardly into the well bore. If the drill string, and consequently the drive sub 4 are withdrawn from the well casing, the dogs pivot inwardly and slide upwardly through the casing 2.

If the well produces bad water or is dry, and the casing 2 is to be removed from the well, the solid plugs 45 in the sub body 18 are replaced with the plugs 46. The sub 4 is reversed, i.e. turned end for end in the drill string, and the sub 4 is slid downwardly in the casing 2 until the dogs 28 pivot outwardly into the groove 11. The drill string and the sub 4 can then be pulled upwardly to remove the casing from the well. If the casing 2 is stuck, rather than abandoning the sub 4 and drill string attached thereto, it is merely necessary to pressurize the drill string, i.e. to pump liquid into the drill string. The liquid is discharged through the passages 47 in the plugs 46 to pivot the dogs 28 around the axles of the pins 29, i.e. to retract the dogs. Thus, the dogs 28 disengage the shoulder 13 of the shoe 3, so that the sub 4 and the drill string can be pulled upwardly. If the fluid pressure does not cause the dogs 28 to retract sufficiently to release from the shoe 3, the sub 4 is rotated. Rotation of the sub 4 causes the dogs 28 to ride inwardly on the sides 16 of the ramps 15, whereby the dogs are slid into a retracted position, permitting removal of the sub 4 and the drill string from the casing 2.

Thus, there has been described a relatively simple apparatus for driving a well casing which facilitates downward or upward movement of a casing in a well bore. The driving force of the dogs is transmitted to the plastic casing through a metal shoe, whereby the driving force is distributed throughout the periphery of the shoe and the casing. Thus the likelihood of damage to the casing is substantially reduced.

I claim:

1. An apparatus for driving a well casing comprising shoe means for attachment to the bottom end of a well casing; upper shoulder means in said shoe means; lower shoulder means opposing said upper shoulder means in said shoe means; drive sub means for insertion into a drill pipe string slidable in said well casing and in said shoe means; dog means pivotal in said sub means for engaging one of said upper and lower shoulder means; and spring means for biasing said dog means outwardly into engagement with one said shoulder means, whereby, when said drive sub means is slid into said shoe means and said dog means engages said lower shoulder means, vertical force exerted on said drive sub means will cause said dog means to bear against said lower shoulder means to effect downward vertical movement of said shoe means and consequently of the well casing, and, when said drive sub means is inverted, said dog means engages said upper shoulder means to effect upward vertical movement of said shoe means and the well casing.

2. An apparatus according to claim 1, including an annular, rectangular cross section groove in said shoe means having top and bottom sides defining said upper and lower shoulder means.

3. An apparatus according to claim 2, wherein said drive sub means includes tubular, cylindrical body means; and a plurality of longitudinally extending recess means in said body means for pivotally housing said dog means and for containing said spring means.

4. An apparatus according to claim 3, wherein said spring means is a helical spring sandwiched between one end of said dog means and said body means in said recess means for biasing said one end outwardly, whereby, when the dog means is aligned with said annular grove, said one end of said dog means enters said groove for engaging one said shoulder means.

5. An apparatus according to claim 2, including ramp means in said groove at one said upper shoulder means for alignment with said dog means when the sub means is rotated, whereby when the dog means aligned with said ramp means, the dog means can be slid vertically out of said groove permitting release of the drive sub means from said shoe means.

6. An apparatus according to claim 3, including radially extending threaded holes in said body means, first solid plug means for closing said holes when the apparatus is used to drive a well casing downwardly; and second plug means having a passage therethrough for discharging fluid under pressure against said dog means to cause the latter to pivot to a retracted position out of engagement with said upper shoulder means, whereby said drive sub and the drill string can be withdrawn upwardly from the shoe means and the well casing.

7. An apparatus according to claim 5, including ramp means in said groove at said upper shoulder means for alignment with said dog means when the sub means is rotated, whereby when the dog means is aligned with said ramp means, the dog means can be slid vertically out of said groove to release the sub means from the shoe means.

* * * * *